United States Patent [19]

Estabrook

[11] 3,999,709

[45] Dec. 28, 1976

[54] WATER HEATER

[76] Inventor: Paul S. Estabrook, Rte. 1, Box 96, Martinsburg, W. Va. 25401

[22] Filed: May 5, 1975

[21] Appl. No.: 574,642

[52] U.S. Cl. ..... 237/8 R; 237/19; 237/59; 165/DIG. 2

[51] Int. Cl.[2] ..... F24D 3/08; F24H 1/22

[58] Field of Search ..... 237/8 R, 54, 55, 59, 237/19, 81; 165/DIG. HS

[56] References Cited

UNITED STATES PATENTS

| | | | |
|---|---|---|---|
| 2,026,399 | 12/1935 | Pierce | 237/19 |
| 2,166,355 | 7/1939 | Higgins et al. | 237/19 |
| 2,201,406 | 5/1940 | Miller | 237/19 |
| 3,096,021 | 7/1963 | Lintvedt | 237/8 R |
| 3,896,992 | 7/1975 | Borovina et al. | 237/8 R |

*Primary Examiner*—John J. Camby
*Assistant Examiner*—Henry C. Yuen
*Attorney, Agent, or Firm*—Thomas N. Tarrant

[57] ABSTRACT

Apparatus and method for providing heat to a hot water storage system in which water from the storage system is circulated through a heat exchanger in the flue of a combustion heat source and circulatory flow is provided by a circulating pump in a secondary circulatory system including a heat exchanger having greater heat transfer capacity than the heat exchanger in the flue so as to dissipate excess heat at a controllable rate.

7 Claims, 1 Drawing Figure

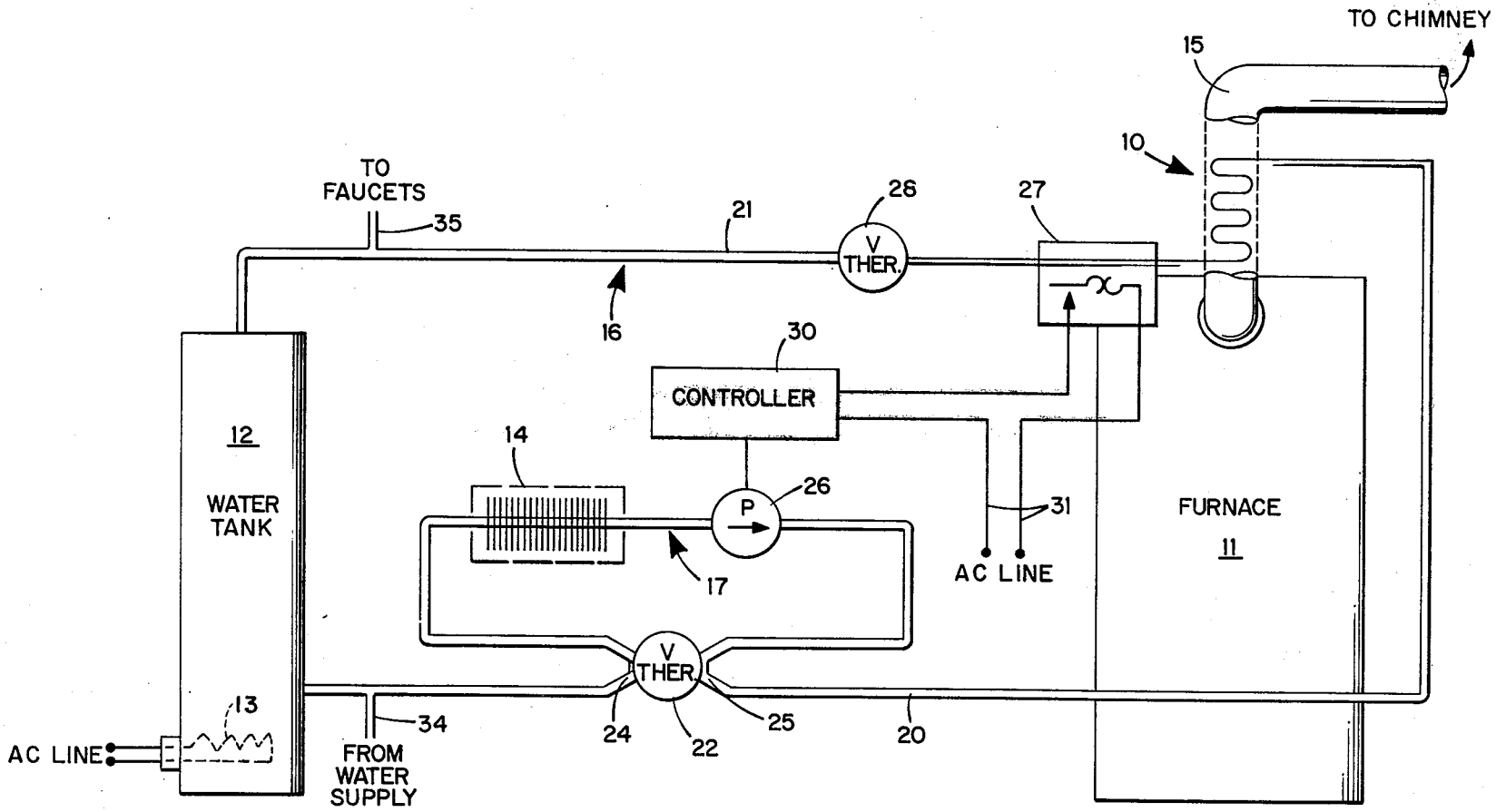
TO CHIMNEY
15
10
FURNACE
11
27
31
AC LINE
26
V
THER.
20
30
CONTROLLER
26
P
25
21
17
22
V
THER.
16
24
14
35
34
TO
FAUCETS
FROM
WATER
SUPPLY
12
WATER
TANK
13
AC LINE

WATER HEATER

BACKGROUND OF THE INVENTION

1. Field of the Invention

The present invention relates to heating apparatus and particularly to heating apparatus that obtains heat by circulating water through a heat exchanger in the flue of an independent combustion heat source.

2. Description of the Prior Art

A common hot water heater of some years back used a storage tank with a separate gas-fired combustion unit containing a helix of copper tubing. The bottom of the tank was connected to the bottom of the helix while the top of the helix was connected to the top of the tank. Cold water from the bottom of the tank would rise through the helix as it was heated by the gas flame and pass into the top of the tank. The gas would be turned off when a predetermined temperature was reached. Today domestic hot water heaters are most commonly one of three types: Storage tank with integral gas burner, storage tank with integral electric heating elements and heat exchanger connected into a central hearing furnace of the water or steam types with or without storage tank.

Domestic hot water heaters operating off central heating furnaces conventionally absorb their heat from the water in the furnace rather than directly from the flue gasses. This is necessary so that the domestic hot water does not reach a dangerously high temperature while at the same time avoiding the necessity of turning off the furnace merely because the domestic hot water is too hot. This is the same reason that domestic hot water is seldom drawn from hot air furnaces. The hot air readily rises far above the boiling point of water and would require shutting down the central heating system when the domestic hot water approached a hazardous temperature level.

Besides the above limitations, it has always been a disadvantage of using a central heating furnace for domestic hot water that in the summer it results in operating an inefficiently large unit for providing a small amount of heat. On the other hand, in cold weather when the central heating furnace is functioning anyway, the central heating furnace becomes a much cheaper and more efficient source than the electricity or gas integral units in integrated hot water heaters.

SUMMARY OF THE INVENTION

Now in accordance with the present invention a method and apparatus are provided for providing heat to a hot water storage unit from a heat exchanger in the flue of an independent combustion heating unit without the water in the storage unit ever reaching a temperature that would require shutting down the combustion heating unit. In use for domestic hot water, integral gas or electric heating is used with the storage tank to maintain water temperature when the independent combustion heating unit is not operating. To accomplish this, the flue mounted heat exchanger is connected in a circulatory loop with the storage tank and a secondary circulatory loop is connected in the line of the primary loop going from the tank to the flue for dissipating excess heat. A circulating pump in the secondary loop provides circulation in both loops. A thermostatic valve in the line from the flue to the tank prevents circulation until the water in the flue mounted heat exchanger reaches a minimum temperature while a second thermostatic valve located at a juncture between the primary and secondary circulatory loops controls the volume of water flowing in the secondary loop so that flow increases as water temperature exceeds a predetermined level.

Thus it is an object of the invention to provide a flue mounted heat exchanger connected in a circulatory loop with a hot water storage system to provide auxiliary hot water heating from a combustion heating unit otherwise independent of the hot water storage system.

Further objects and features of the invention will become more fully understood upon reading the following description together with the Drawing.

BRIEF DESCRIPTION OF THE DRAWING

The FIGURE is a diagram, partially schematic and partially block, depicting a hot water heating and storage system according to the invention.

DESCRIPTION OF THE PREFERRED EMBODIMENT

A preferred embodiment of the present invention is designed to take heat from the flue of a central heating furnace to provide auxiliary heat to a domestic hot water heater during operation of the furnace. Overheating is prevented by a unique dissipating arrangement in the line going to the flue from the domestic hot water heater. Since the furnace is only operated in cold weather, the heat dissipating arrangement can be installed in a room or other space requiring heat.

As depicted in the drawing, the main components of the system are: flue mounted heat exchanger 10 in stack 15 of central heating furnace 11, water tank 12 and external radiator 14. Heat exchanger 10 is suitably a helix of copper tubing mounted in stack 15 of furnace 11 between the furnace and a chimney. Furnace 11 may be fired by gas, oil or other combustible material and may be of the hot water, steam or hot air type. Furnace 11 is operated in accordance with the demands of the central heating system without regard to the operation of the present water heating system. Water tank 12 is depicted as a hot water storage tank with integral electric heating. An integral gas or oil-fired unit may be in water tank 12 instead of electric heating elements 13. Primary loop 16 for water circulation connects heat exchanger 10 with water tank 12. Secondary loop 17 for water circulation is interconnected with primary loop 16. Radiator 14, suitably made of finned copper tubing conventional for radiation from hot water heating systems, is connected in secondary loop 17.

Radiator 14 is designed to provide greater heat transfer to ambient air, from circulating water at the predetermined holding temperature for water tank 12, than the heat transfer through heat exchanger 10 at the maximum operating temperature in stack 15.

Feed portion 20 of primary loop 16 connects the bottom of water tank 12 to heat exchanger 10. Return portion 21 of primary loop 16 connects heat exchanger 10 to the top of water tank 12. Thermostatic valve 22, that opens on rising temperature exceeding a predetermined level, is connected in the circulation path of feed portion 20. Thermostatic valve 22 is also connected in the circulation path of secondary loop 17. Thus feed portion 20 of primary loop 16 connects to secondary loop 17 at common junctures 24 and 25 on either side of valve 22, juncture 25 being on the side of valve 22 closer to heat exchanger 10.

Secondary loop 17 contains circulating pump 26 in series with radiator 14. Pump 26 is of the centrifugal or other conventional circulating type providing a flow which varies inversely with back pressure.

Return portion 21 of primary loop 16 is thermally coupled to thermostatic switch 27 and has a second thermostatic valve 28 in its flow path. Switch 27 closes when rising temperature reaches a predetermined level while valve 28 opens on rising temperature exceeding a predetermined level. Both switch 27 and valve 28 are positioned as close as convenient to stack 15 so that rising water temperature in heat exchanger 10 is sensed with a negligible delay. Thermostatic switch 27 is connected in series with electric supply line 31 to controller 30 providing power to pump 26. Thermostatic valves 22 annd 28 are both of conventional type such as used in automotive cooling systems set to open and close at the desired temperatures.

The pipe size in secondary loop 17, the size of pump 26, the valve orifice in valve 22 and the ports in junctures 24 and 25 interconnecting primary and secondary loops 16 and 17 and connecting them to valve 22 are all selected to provide an increase in water flow through secondary loop 17 relative to flow in primary loop 16 as valve 22 opens.

Connection from a water supply such as a well or city water main is suitably made in feed portion 20 as depicted by connecting tee 34. Connection to the household hot water piping faucets is suitably made in return portion 21 as depicted by connecting tee 35.

When furnace 11 is not operating, as in summer, the integral heating unit for tank 12 provides the hot water heating source while valve 28 prevents circulation between tank 12 and heat exchanger 10. When furnace 11 fires, flue gases heat water in heat exchanger 10 so that heat transmitted to switch 27 and valve 28 closes and opens them respectively. Closing of switch 27 starts pump 26 which then circulates water along the path from tank 12 through juncture 24, radiator 14, pump 26, juncture 25, heat exchanger 10, valve 28 and back to tank 12. All flow goes through primary and secondary loops 16 and 17 serially with no passage through valve 22 which remains closed. Valve 22 is set to open at or near the desired holding temperature in tank 12. Water going to valve 22 comes either from the water supply or the bottom of tank 12.

When no water is being drawn and the tank temperature reaches the holding level, valve 22 opens. Valve 22 then provides a reduced back pressure recirculation path in secondary loop 17. Under these conditions, water flow in secondary loop 17 and thus radiator 14 exceeds water flow through primary loop 15 and thus heat exchanger 10. This increased flow in radiator 14 increases heat dissipation in radiator 14. At the same time the raised water temperature increases the temperature differential at radiator 14 while decreasing the temperature differential at heat exchanger 10. Temperature stabilization is reached at the desired point and it is believed this is fully due to the theory of heat transfer described above. However the theory of heat transfer is not part of the invention and the system as described provides the desired temperature stabilization in actual practice.

While the invention has been described with relation to a specific embodiment, many variations are obvious within the inventive concept and the invention is useful for heating water in connection with other systems than domestic hot water and with storage tanks with or without integral separate heating sources. Thus it is intended to cover the invention with the full scope of the appended claims.

I claim:

1. A method of providing heat to a hot water storage system comprising:

a. circulating water in a primary loop from a heat exchanger located in the flue of an independent combustion heating unit to said storage system;

b. inducing flow in said primary loop by a pump located in a secondary loop joined to said primary loop at a thermostatic valve;

c. dissipating excess heat by circulating water from said primary loop through a heat dissipator located in said secondary loop;

d. recirculating water within said secondary loop through said heat dissipator at an increasing rate relative to circulation in said primary loop as the temperature of water in said secondary loop rises above a first predetermined level until temperature stability is achieved; and, e. halting all said circulating responsive to the temperature of water from said heat exchanger falling below a second predetermined level.

2. A method of providing heat according to claim 1 further comprising restricting recirculation in said secondary loop by closing of said thermostatic valve at water temperatures below said first predetermined level whereby said pump circulates water flow in said secondary loop equal to flow in said primary loop and said recirculating water within said secondary loop through said heat dissipator at an increasing rate comprises opening of said thermostatic valve at water temperatures above said first predetermined level whereby said pump recirculates water in said secondary loop in shunt with and increasingly exceeding flow in said primary loop as water temperature in said secondary loop increasingly exceeds said first predetermined level.

3. Apparatus for heating water comprising:

a. a water storage unit;

b. an independent combustion heating unit;

c. a heat exchanger mounted in the flue of said combustion heating unit;

d. a water circulation primary loop connected from said storage unit to said heat exchanger and back to said storage unit to provide a water flow path;

e. a water circulation secondary loop containing a heat dissipator connected in series to said primary loop between said storage unit and said heat exchanger in the path from said storage unit to said heat exchanger;

f. a circulating pump in said secondary loop for providing simultaneous circulatory flow in both said primary and secondary loops; and, g. thermostatic flow control means in shunt across the connections that connect said primary and secondary loops in series to control secondary loop water flow relative to primary loop water flow as a function of water temperature.

4. Apparatus for heating hot water according to claim 3 wherein said water storage unit is a domestic hot water heater with integral heating means, said combustion heating unit is the furnace of a central heating system and thermostatically controlled means are provided to inhibit flow in said primary loop when water in said heat exchanger is below a predetermined temperature level.

5. Apparatus for heating hot water according to claim 3 wherein a first thermostatic valve is located in the primary loop path from said heat exchanger to said storage unit blocking water flow and set to open at a first predetermined temperature level as water is heated in said heat exchanger; and, a second thermostatic valve part of said thermostatic flow control means that open a recirculation path in said secondary loop when water flowing in said secondary loop exceeds a second predetermined temperature level.

6. Apparatus for heating hot water according to claim 5 wherein said heat dissipator has greater thermal exchange capacity than said heat exchanger.

7. Apparatus for heating water comprising:

a. a water storage unit;

b. an independent combustion heating unit having a flue;

c. a heat exchanger mounted in said flue;

d. a water circulation primary loop connected from said storage unit to said heat exchanger and back to said storage unit to provide a water flow path;

e. a first thermostatic valve located in the primary loop path from said heat exchanger to said storage unit blocking water flow and set to open at a first predetermined temperature level as water is heated in said heat exchanger;

f. a water circulation secondary loop containing a heat dissipator and a circulating pump connected in series for circulating water therethrough;

g. an interconnection of said primary loop with said secondary loop inbetween said storage unit and said heat exchanger, said interconnection comprising a second thermostatic valve connected in common in both said primary loop and said secondary loop by first and second junctures between said primary and said secondary loops at an inlet side and an outlet side respectively of said second thermostatic valve, said pump providing simultaneous flow in both said primary and said secondary loops and said second thermostatic valve set to open at a second predetermined temperature level whereby below said second temperature level said first and second junctures direct all water flow in said primary loop through said secondary loop in serial fashion and above said second temperature level said second thermostatic valve opens a recirculation path for said secondary loop so that water flow in said secondary loop exceeds water flow in said primary loop above said predetermined temperature level.

* * * * *